US005913757A

United States Patent [19]

Winters

[11] Patent Number: 5,913,757

[45] Date of Patent: Jun. 22, 1999

[54] CRUNCH ABDOMEN EXERCISE APPARATUS

[76] Inventor: Jackie Ray Winters, 3735 1/2 Bentley Ave., Los Angeles, Calif. 90034

[21] Appl. No.: 08/773,079

[22] Filed: Dec. 26, 1996

[51] Int. Cl.[6] ..... A63B 21/00

[52] U.S. Cl. ..... 482/140; 482/142; 482/123

[58] Field of Search ..... 224/637, 262, 224/646, 649; 2/80, 69.5, 75, 79, 69, 227, 228, 230; 482/140, 123, 142

[56] References Cited

U.S. PATENT DOCUMENTS

| | | | |
|---|---|---|---|
| 1,095,476 | 5/1914 | Sprague | 2/80 |
| 2,015,589 | 9/1935 | Cahn | 2/80 |
| 5,122,107 | 6/1992 | Gardner | 482/140 |
| 5,131,576 | 7/1992 | Turnipseed | 224/637 |
| 5,209,691 | 5/1993 | Ekstein | 2/80 |
| 5,458,549 | 10/1995 | Obery | 482/140 |
| 5,540,364 | 7/1996 | Krieger et al. | 224/637 |
| 5,577,653 | 11/1996 | Bieker | 224/660 |

*Primary Examiner*—Jerome Donnelly
*Attorney, Agent, or Firm*—Mitchell, Silberberg & Knupp, LLP

[57] ABSTRACT

According to the present invention, there is provided an apparatus to facilitate the crunch abdomen exercise. The apparatus is generally made of flexible material such as canvas or denim. A main central portion is sized generally to fit the back of a person. The main central portion is thinner than it is wide or long. At least one handle extends from the top end of the main central portion for grasping during the crunch exercise. Preferably, the handle section comprises two looped straps which extend from the top of the main central portion. At the bottom end of the main central portion, a means of securing the body of the person to the main central person is operatively connected to the main central portion. Preferably, a belt is attached to the main central portion which secures around the waist of the person.

13 Claims, 3 Drawing Sheets

CRUNCH ABDOMEN EXERCISE APPARATUS

BACKGROUND OF THE INVENTION

1. Field of the Invention

The present invention generally relates to the art of physical exercise machines and more specifically to an apparatus for the crunch abdomen exercise.

2. Description of the Related Art.

In recent years, physical exercise experts have basically abandoned the traditional sit up exercise for exercise of the abdomen. Instead, such experts recommend that persons use the "crunch" exercise in order to exercise their abdomens. The crunch exercise is similar to a sit up but the movement is more limited. The head of the person doing the crunch does not approach his or her knees or legs. A crunch is in essence a half-way roll-up, with the body being bent at the abdomen. The crunch exercise provides more focus for the abdomen muscles than does the sit up and causes less back and neck strain, if any is caused at all.

A number of different devices have been developed to facilitate persons doing the crunch exercise. One is a crunch board, which is an inclined board whereby the feet of the person are strapped at the higher end and the crunch exercise is performed. Another type of device is a crunch machine. The person sits on the machine and holds handles which are behind and above the shoulders. As the person does the crunch exercise, he or she pulls the handles, which are weighted. Finally, there are metal frames to facilitate the crunch exercise. The person lies on the floor and the metal frame leads the person through the crunch exercise as it is rotated.

There are a number of problems associated with these prior art devices. First, they are not easily ported or stored. Second, they are expensive to manufacture and purchase. Third, they do not provide back support to the person exercising during the entirety of the crunch movement.

SUMMARY OF THE INVENTION.

According to the present invention, there is provided an apparatus to facilitate the crunch abdomen exercise. The apparatus is generally made of flexible material such as canvas or denim. A main central portion is sized generally to fit the back of a person. The main central portion is thinner than it is wide or long. At least one handle extends from the top end of the main central portion for grasping during the crunch exercise. Preferably, the handle section comprises two looped straps which extend from the top of the main central portion. At the bottom end of the main central portion, a means of securing the body of the person to the main central person is operatively connected to the main central portion. Preferably, a belt is attached to the main central portion which secures around the waist of the person.

Other objects, features, and advantages of the present invention will become more apparent from a consideration of the following detailed description and from the accompanying drawings.

DESCRIPTION OF THE PREFERRED EMBODIMENTS.

Figure 2:
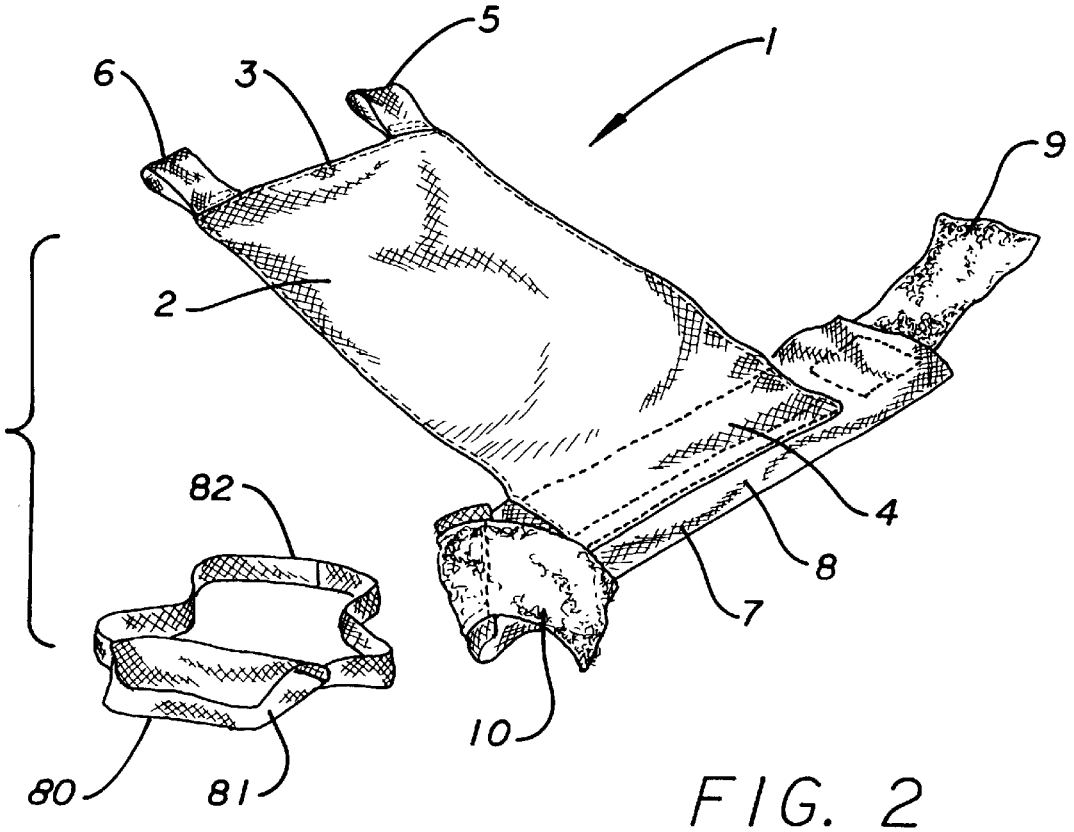
FIG. 2 is an illustration of the present invention.

FIG. 2 illustrates an embodiment of the crunch abdomen exercise apparatus 1 herein. The apparatus comprises three main parts, a main central portion 2, a handle section (5 and 6) located at the top end of main central portion and a securing means section 7 located at the lower end of the main central portion. The apparatus works as follows: (1) the person intending to do the crunch exercise places the apparatus on the ground or floor; (2) the person lays down on the apparatus, with his or her back to the apparatus; (3) the person uses the securing means section to secure his or her body to the main central portion; (4) the person grasps the handle section with one or both hands; (5) the person performs the crunch exercise pulling on the handle section in the direction toward his lower body and curling his or her body forward while bending at the abdomen. As the person's upper body moves forward toward the lower body during the crunch exercise, the main central portion continually presses against the back and shoulders of the person due to the person's pulling on the handle section.

As shown in FIG. 2, the apparatus comprises a main central portion 2. Generally, this main central portion is rectangular as shown in the figure, although other shapes and sizes may be used for the main central portion. The main central portion may be made of any flexible material, including, for example, flexible plastic or fabric. Fabrics which can be used include, for example, denim, canvas or terry cloth. In the specific embodiment of FIG. 2, the main central portion is made of canvas and is 14" wide and 30" long.

The main central portion has a top end 3 and a bottom end 4. "Top end" as used herein is not necessarily limited to the exact top but generally includes the top section of the main central portion. Likewise, "bottom end" as used herein is not necessarily limited to the exact bottom but generally includes the bottom section of the main central portion.

A handle section is operatively connected to the main central portion at the top end. Specifically, in this embodiment, the handle section comprises two looped straps, 5 and 6, fastened to the top end of the main central portion. Here, the looped straps are stitched to the main central portion. The looped handles are spaced apart such that they are on either side of the head of the person using the exercise apparatus and such that, when pulled during the exercise, come over the person's shoulders. Structure other than two looped straps can be used for the handle section. For example, one strap might be used instead of two. Accordingly, a long strap secured to the top end of the main central portion at both ends of the strap might be used such that a person can grasp the same strap with both hands. Or handle means other than a strap might be used, such as wooden or hard plastic handles attached to the main central portion by rope, chain or fabric.

The important aspect of the handle section is that the person using the apparatus be able to grasp and pull the handle means over the shoulders. As such, it is not necessary that the handle section be flexible. Further, the looped straps specifically shown in FIG. 2, which in this embodiment are made of canvas, can be attached by means other than stitching. Moreover, the straps can be cut from the same piece of material as is the main central portion such that the straps and main central portion are one piece and attachment by stitching or other means is not necessary.

Attached to the bottom end of the main central portion is a securing means section 7. Specifically, in the embodiment shown in FIG. 2, the securing means section comprises a belt connected to the bottom end 4 of the main central portion 2. In the figure, the belt comprises three parts. The first is a central elongated belt portion 8. This can be made of any flexible material. Flexible, stretchable material, such as elastic, can be used. On each end of the central elongated belt portion there are velcro straps (9 and 10) such that the belt can be secured around the waist of a person. Means other than velcro can be used to secure the belt such as a buckle, ties, hooks or snaps. Again, stitching has been used to attach these various parts. However, stitching is not the only means by which the parts can be attached. Further, the belt can be made from the same piece of material as is the main central portion such that the belt and main central portion are one piece and no fastening of the belt to the main central portion is required.

It is also possible to form a loop at the bottom end of the main central portion which the belt fits through so that the belt is not fixed to the main central portion. What is important here is that the belt be operatively connected to the main central portion so that the belt serves its intended purpose of securing the main central portion to the body of the person using it. In this respect, the belt might secure the body of the person at some location other than the waist (e.g., lower chest or hips). Further, securing means other than a belt can be used, such as the leggings shown in FIG. 5 or straps which secure around the legs of the person by buckle or otherwise.

Figure 3:
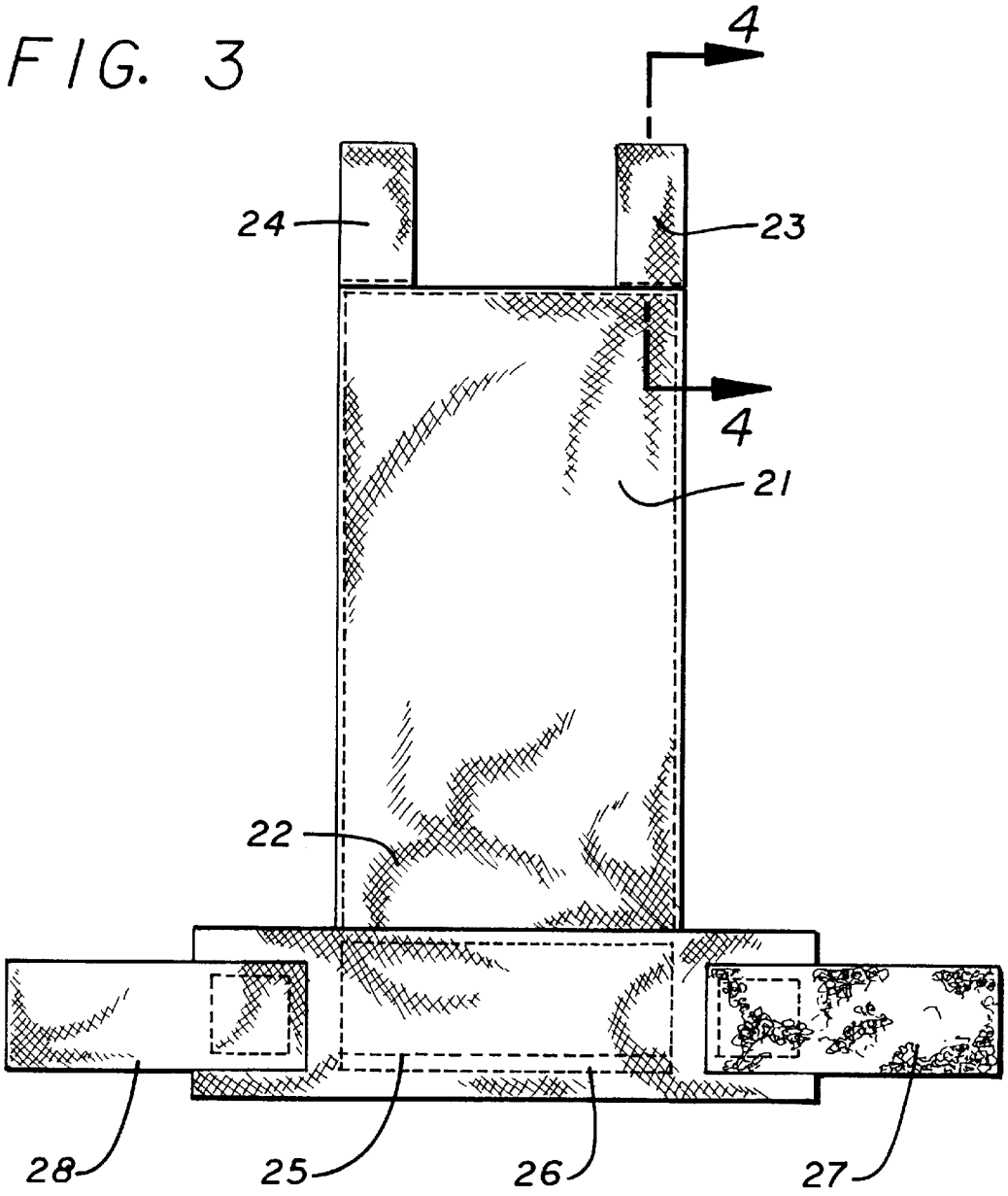
FIG. 3 is an overview of the present invention.
Figure 4:
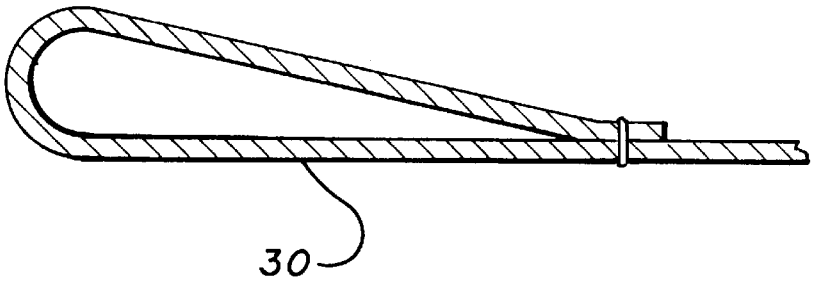
FIG. 4 is a side view one of the straps.

FIG. 3 provides an overview of the present invention. It illustrates the main body part 20, with a top end 21 and a bottom end 22. The two looped straps 23 and 24 are also shown, as is the belt portion 25, comprising the central elongated belt portion 26 and the velcro straps (27 and 28). FIG. 4 provides a side view of one of the looped straps 30.

Figure 5:
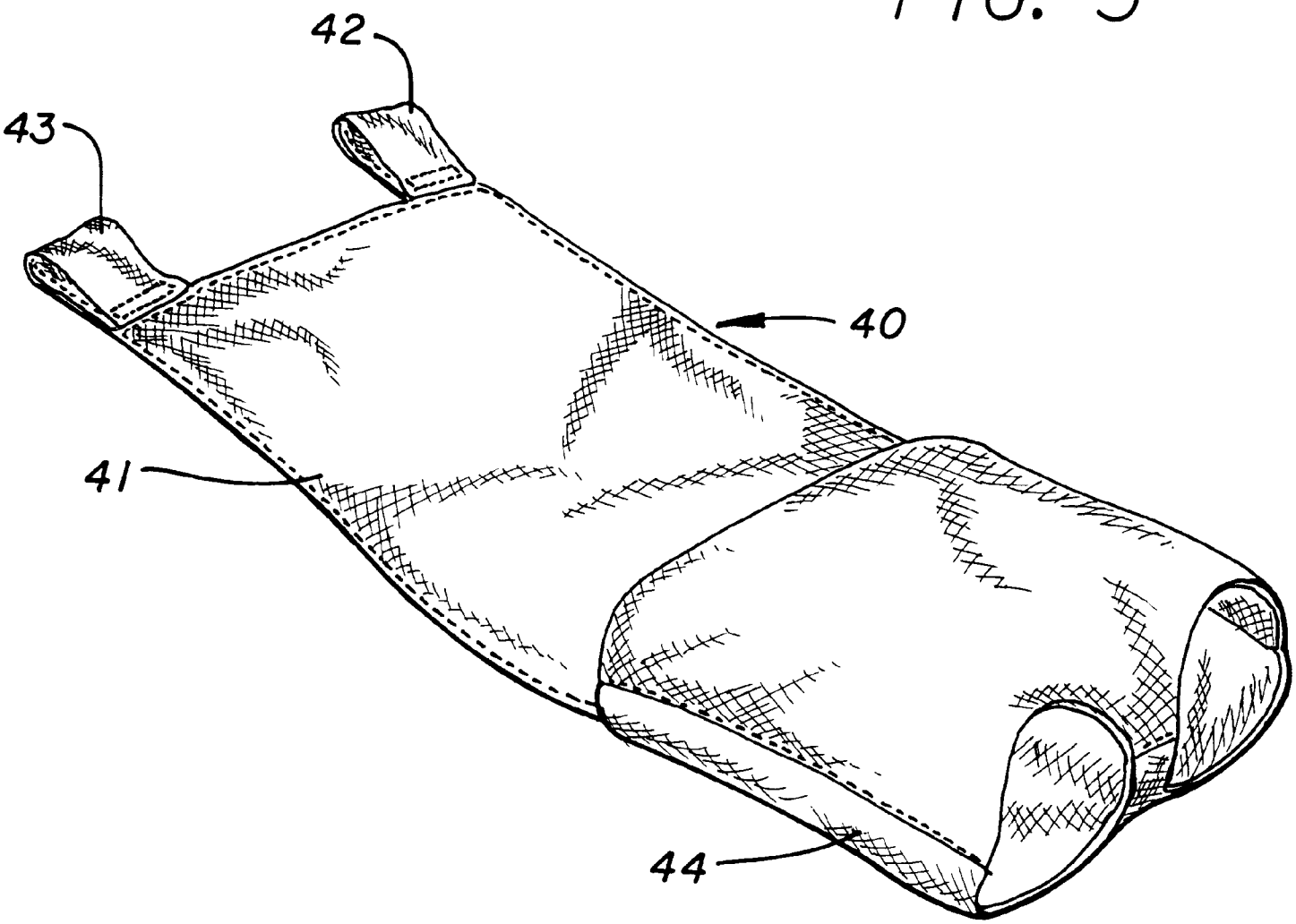
FIG. 5 is an illustration of an additional embodiment of the invention with leggings instead of a belt.

FIG. 5 illustrates a second embodiment 40 of the present invention. This embodiment includes the main central portion 41 and the two looped straps (42 and 43). Instead of a belt system for securing means, leggings 44 are included at the bottom end of the main central portion.

Figure 1:
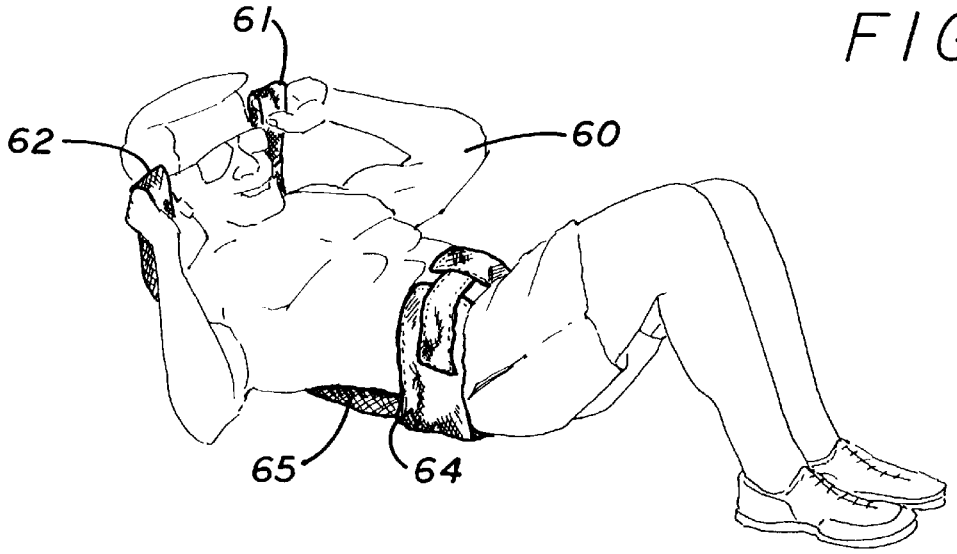
FIG. 1 is an illustration showing the present invention in use.

FIG. 1 illustrates the basic invention in use. The person shown 60 is holding one of the looped straps 61 in one hand work the corresponding shoulder and the second looped strap 62 in the other hand over the corresponding shoulder. The belt 64 is secured around the waist. The person is laying down on the main central portion 65. The person is performing the crunch exercise by pulling up with the looped straps.

FIGS. 1 and 2 also illustrate the benefits of the present invention. The present invention is inexpensive to make. Only simple materials, which here are shown stitched together, are needed to make it. Also, the apparatus is easily ported and stored. In fact, it can be folded or rolled up and stored in a belt pack 80 as shown in FIG. 2. The belt pack comprises a belt extending from a pouch which is sufficiently large to accept the rolled up and/or folded up crunch abdomen exercise apparatus. In this manner, a person can carry the apparatus when he or she goes to a gym, or elsewhere, to work out. Finally, the central body portion supports the back of the person throughout the crunch exercise.

While the invention has been described in connection with specific embodiments thereof, it will be understood that the invention is capable of further modifications. This application is intended to cover any variation, uses or adaptations of the invention following, in general, the principles of the invention, and including such departures from the present disclosure as come within known and customary practice within the art to which the invention pertains.

I claim:

1. An apparatus for exercising the abdomen, comprising:

(a) a foldable main central portion comprising easily folded material that is thinner than it is wide, said main central portion having a top end and a bottom end opposite said top end, said top end having a right side and an left side;

(b) a right handle fixedly connected to said main central portion and extending from the right side of said top end;

(c) a left handle fixedly connected to said main central portion and extending from the left side of said top end; and (d) a belt connected to said bottom end, wherein the apparatus is configured and sized such that (i) a person can lie down with his or her back on the main central portion with his or her right shoulder proximate to the right handle and left shoulder proximate to the left handle;

(ii) in so lying down on the main central portion, the person can grasp the right handle with the right hand by reaching backward over the right shoulder and simultaneously grasp the left handle with the left hand by reaching backward over the left shoulder;

(iii) in so lying down on the main central portion, the person can secure said main central portion to his or her body by securing said belt around his or her body below the chest and above the legs;

(iv) said right handle is sufficiently short such that, in so lying down on the main central portion, if the person pulls the right handle over the right shoulder and extends the right handle toward the person's lower body, the end of said right handle will not extend proximate to the person's waist; and (v) said left handle is sufficiently short such that, in so lying down on the main central portion, if the person pulls the left handle over the left shoulder and extends the left handle toward the person's lower body, the end of said left handle will not extend proximate to the person's waist wherein the right handle comprises a first closed loop and the left handle comprises a second closed loop.

2. The apparatus of claim 1, wherein the first closed loop is flexible and the second closed loop is flexible.

3. The apparatus of claim 1, wherein each said closed loop is sufficiently large such that, if grasped by said person, the closed loop can comfortably accept the four fingers of the grasping hand.

4. The apparatus of claim 1 wherein the belt comprises velcro.

5. The apparatus of claim 1 wherein the belt comprises a buckle.

6. The apparatus of claim 1 wherein the handles and main central portion each comprise fabric and the handles are connected to the main central portion by virtue of having been fabricated from the same piece of fabric.

7. An apparatus for exercising the abdomen, comprising:

(a) a foldable main central portion comprising easily folded material that is thinner than it is wide, said main central portion having a top end and a bottom end opposite said top end, wherein said top end has a right side and an left side;

(b) a right handle extending from the right side of said top end, said right handle comprising a first closed loop sufficiently large to accept therein the four fingers of a person's hand;

(c) a left handle extending from the left side of said top end, said left handle comprising a second closed loop sufficiently large to accept therein the four fingers of a person's hand; and (d) securing means operatively connected to said bottom end for securing the body of the person below the chest and above the legs to the main central portion, wherein the apparatus is configured and sized such that (i) a person can lie down with his or her back on the main central portion with his or her right shoulder proximate to the right handle and left shoulder proximate to the left handle;

(ii) in so lying down on the main central portion, the person can grasp the right handle with the right hand by reaching backward over the right shoulder and grasping said first closed loop with the four fingers of the right hand placed therethrough and simultaneously grasp the left handle with the left handle by reaching backward over the left shoulder and grasping said second closed loop with the four fingers of the left hand placed therethrough; and (iii) in so lying down on the main central portion, the person can secure said main central portion to his or her body at a location below the chest with said securing means.

8. The apparatus of claim 7, wherein said first closed loop and said second closed loop are each flexible.

9. The apparatus of claim 7, wherein said securing means is a belt.

10. The apparatus of claim 7, wherein said bottom end has a right side and a left side and the belt comprises a left member extending from the left side, a right member extending from the right side and connecting means for connecting said left member to said right member.

11. The apparatus of claim 10, wherein said connecting means comprises velcro.

12. The apparatus of claim 10, wherein said connecting means comprises a buckle.

13. The apparatus of claim 7 wherein the handles and main central portion each comprise fabric and the handles are connected to the main central portion by virtue of having been fabricated from the same piece of fabric.

* * * * *